United States Patent [19]

Cawi et al.

[11] Patent Number: 4,556,480

[45] Date of Patent: Dec. 3, 1985

[54] REMOVAL OF TOPPED CRUDE DEMINERALIZATION SEDIMENT BY BACKWASHING FILTER TO CRUDE OIL DESALTING PROCESS

[75] Inventors: Vernon A. Cawi; Barry J. Stengle, both of Sweeny, Tex.

[73] Assignee: Phillips Petroleum Company, Bartlesville, Okla.

[21] Appl. No.: 643,350

[22] Filed: Aug. 23, 1984

[51] Int. Cl.[4] ..... C10G 33/06; C10G 45/00

[52] U.S. Cl. ..... 208/211; 208/251 R; 210/275

[58] Field of Search ..... 210/275, 416.5; 208/251 R, 177, 211, 209, 305, 186

[56] References Cited

U.S. PATENT DOCUMENTS

| | | | |
|---|---|---|---|
| 1,984,903 | 12/1934 | Wagner | 196/146 |
| 2,685,561 | 8/1954 | Whiteley et al. | 196/71 |
| 2,772,212 | 11/1956 | Seyfried | 208/211 |
| 3,165,466 | 1/1965 | Vautrain et al. | 210/114 |
| 3,416,667 | 12/1968 | Cabbage | 210/104 |
| 3,792,773 | 2/1974 | Ross | 210/275 X |
| 3,798,153 | 3/1974 | Arndt, Jr. et al. | 208/251 R X |
| 3,902,991 | 9/1975 | Christensen et al. | 208/89 X |
| 4,008,147 | 2/1977 | Kondo | 208/251 R |
| 4,082,653 | 4/1978 | DeGraff | 208/251 R |
| 4,265,731 | 5/1981 | Mitchell | 208/80 |
| 4,269,694 | 5/1981 | Holland et al. | 208/48 R |
| 4,344,841 | 8/1982 | Johnson et al. | 208/211 |

*Primary Examiner*—D. E. Gantz
*Assistant Examiner*—Glenn A. Caldarola
*Attorney, Agent, or Firm*—A. W. Umphlett

[57] ABSTRACT

A method for removing the mineral sediment from a crude oil processing system which entails filtering a topped crude oil to remove mineral sediment and backwashing the removed sediment using topped crude oil with subsequent recycle of the backwash stream to a point in the process prior to a desalting operation.

4 Claims, 1 Drawing Figure

REMOVAL OF TOPPED CRUDE DEMINERALIZATION SEDIMENT BY BACKWASHING FILTER TO CRUDE OIL DESALTING PROCESS

BACKGROUND OF THE INVENTION

This invention relates to treating crude oil. In one of its aspects this invention relates to removing mineral sediment from crude oil. In another of its aspects this invention relates to the use of filtration for removal of mineral sediment from treated crude oil. In still another of its aspects this invention relates to the removal of mineral sediment from a system for treating crude oil.

In the treating of crude oil to recover a maximum of useable hydrocarbons a problem arises in determining the most economical and ecologically sound means for disposing of mineral sediment or sludge that is removed from the crude oil during processing.

In a typical operation crude oil is desalted or demineralized by contacting heated crude oil with water or water containing about 4 to 5 percent soda ash in solution and an emulsion breaking compound with passage of the contact mixture through a suitably baffled and/or agitated vessel to allow removal of mineral contaminant into a separated water phase while an at least partially demineralized oil phase is separately removed for further treatment. Further treatment usually involves a fractionation operation which produces a residue, a topped crude oil containing mineral sediment that had not been previously removed. Normally this topped crude oil is subjected to hydrodesulfurization followed by further fractionation of the hydrodesulfurized product. The sediment contained in the topped crude is deleterious to the hydrodesulfurization catalyst and is, therefore, usually removed by filtering the topped crude before passing the oil to the hydrodesulfurzation process.

In a typical operation, as is well known in the prior art, this sediment collected on the filtering apparatus is removed from the filter by backwashing with a stream of topped crude oil which is charged along with the sediment removed from the filter into the distillation apparatus used to fractionate the hydrodesulfurized, topped crude oil that was prepared from the topped crude oil that passed through the filter. In other words, this mineral sediment has in the past been removed from the process streams only to bypass the hydrodesulfurization unit thereby protecting the catalyst.

The present invention provides an ecologically sound process by which the sediment does not find its way back into the stream of product oil but is, instead, removed as waste from the system.

It is therefore an object of this invention to provide a method for removing mineral sediment from a topped crude oil. It is another object of this invention to provide means for disposing of sediment retained during filtering of a topped crude oil stream that does not entail recontaminating the topped crude oil stream from which the sediment was removed.

Other aspects, objects and the various advantages of this invention will become apparent from study of this specification, the drawing, and the appended claims.

STATEMENT OF THE INVENTION

Figure 1:
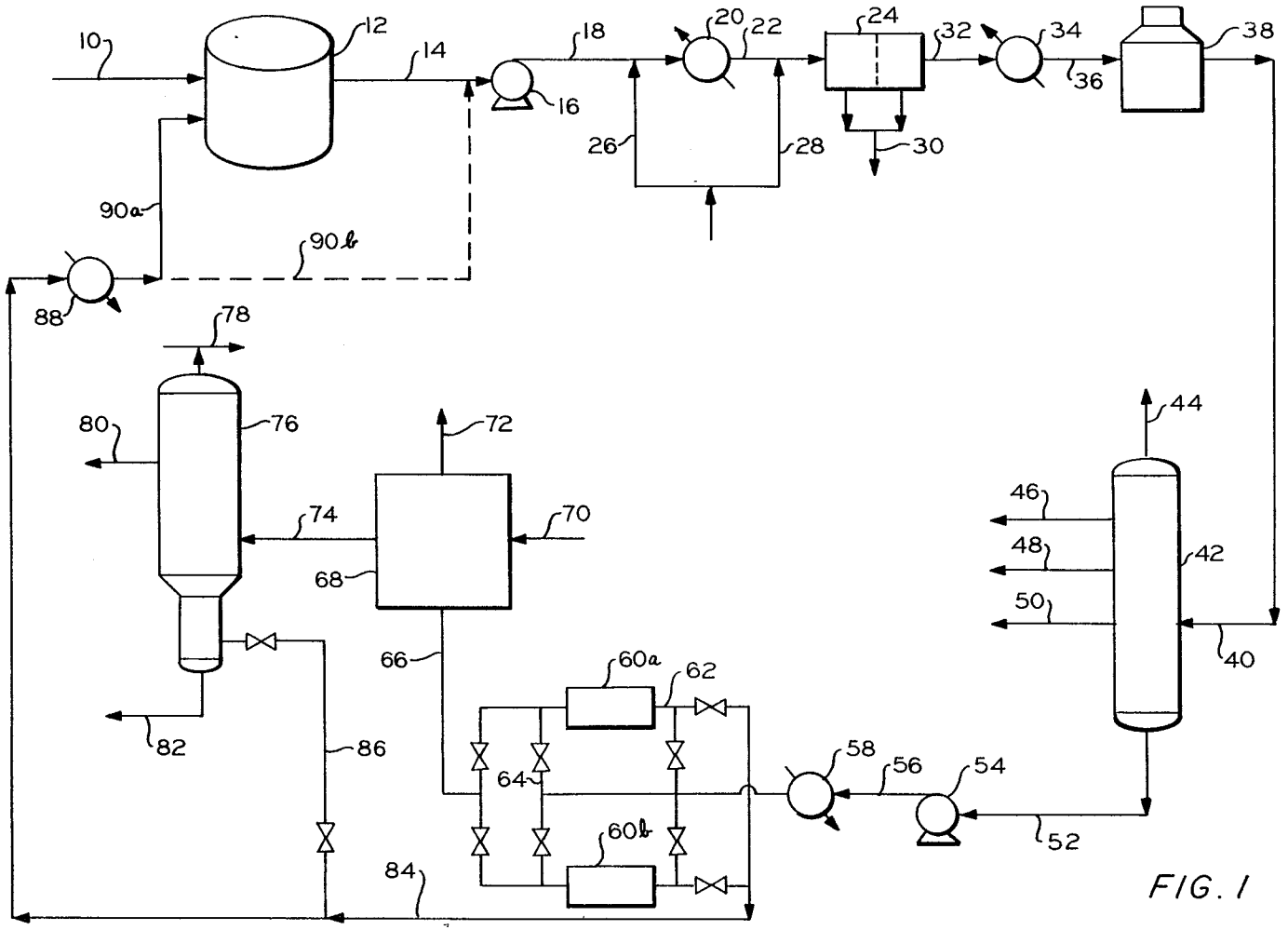
FIG. 1 illustrates a schematic of the crude oil demineralization process.

In accordance with this invention a method is provided for removing mineral sediment from an at least partially desalted, topped crude oil. The method entails passing the desalted, topped crude oil through a filtering means with mineral sediment retained on the filtering means to provide a topped crude oil stream reduced in mineral sediment. The filtering means is backwashed with desalted topped crude oil thereby removing the mineral sediment from the filtering means and the backwash, the desalted topped crude oil containing mineral sediment from the backwashing, is passed to a desalting operation in which the mineral sediment is at least partially removed.

In a further embodiment of the invention the backwash stream, the desalted topped crude oil and mineral sediment from the backwashing, is combined into a stream of fresh crude oil containing mineral sediment before the fresh crude oil is passed to a desalting operation in which it is at least partially desalted, the at least partially desalted crude oil is then passed to a fractionation operation from which an at least partially desalted, topped crude oil stream is recovered.

In a still further embodiment of the invention the topped crude oil stream that is the effluent from the filtering is subjected to hydrodesulfurization to provide a hydrodesulfurized topped crude stream which is then vacuum distilled to produce a vacuum gas oil product stream and a residual stream.

Combining the embodiments of the invention it can be seen that a process is provided for treating a crude oil first by desalting, i.e. at least partially removing mineral sediment, fractionating the desalted crude oil to produce product streams and a residual of desalted, topped crude oil which is then filtered to remove mineral sediment with the filtered oil passed to a hydrodesulfurizing operation and thence to a vacuum distillation for further separation into product oil streams. The filter operation is backwashed to remove the mineral sediment with a backwash stream cycled to join the incoming crude oil before it is passed to the desalting operation. The present invention, therefore, provides an improvement in an otherwise established combination of processes, but an improvement that increases the overall value of product from the combination of processes.

The value of the invention can best be understood by discussion in conjunction with the drawing which is a line diagram of the overall process which includes the invention and which allows the process of the prior art to be compared to the process of the present invention.

Referring now to the drawing, crude oil is passed through line 10, storage tank 12 and line 14 to be transferred by pump 16 through line 18 preheater 20 and line 22 into desalting apparatus 24. Water or water plus soda ash in an about 4 to 5 percent solution along with an emulsion breaking compound, such as a polyalkoxylated resin, are added to the crude oil either before or after the preheater 20 through lines 26 or 28. The heated crude oil and water are separated in the desalting unit 24 (apparatuses and processes for which are well known in the art) with at least part of the mineral sediment that had been contained in the crude oil being removed with the water through outlet line 30.

At least partially desalted crude oil is passed through line 32 preheater 34 conduit 36, furnace 38 and conduit 40 into a fractionation column 42. From the atmospheric distillation process butane and lighter gases are recovered through line 44 for further processing. Straight run gasoline is removed through line 46, distillate—e.g., kerosene—is removed through line 48 and virgin gas oil is recovered through line 50. The virgin gas oil is preferably charged to a "clean oil" catalytic cracking unit (not shown). The residuum from the fractionation, topped crude, is removed through line 52, pump 54, line 56 and cooler 58 into a filter system which is valved so that the filter units 60A and 60B can be operated so that the topped crude oil can pass through line 62 and filter 60A depositing the mineral sediment in the filter and producing a topped crude oil stream reduced in mineral sediment which is then passed through line 66 into hydrodesulfurization process 68.

In the hydrodesulfurization which can be operated under conditions well known in the art using catalyst well known to the art the topped crude oil stream through line 66 and hydrogen through line 70 pass through a catalyst bed such as cobalt-molybdenum type hydrodesulfurization catalyst with the hydrogen reacting with the sulfur compounds in the topped crude to remove the sulfur as hydrogen sulfide through line 72. Desulfurized topped crude is passed through line 74 to a conventional vacuum distillation column 76 which, operating under a vacuum produced by vacuum system 78, yields a vacuum gas oil through line 80 which can also be charged to the "clean oil" catalytic cracker (not shown) and yields a residue through line 82 which can be charged to a "dirty oil" or a residuum catalytic cracker (not shown).

Returning now to the filter unit, in the systems of the prior art while topped crude oil is being filered through filter 60A a portion of the topped crude oil is passed through line 64 to backwash filter 60B which has collected mineral sediment and has been removed from service for cleaning. The topped crude oil passing through line 64 and backwashing filter 60B removes mineral sediment and a combination of topped crude oil containing mineral sediment from the backwashing is passed through line 84 and line 86 into a vacuum distillation column 76. It can readily be seen that this contamination is then removed with a residual from the vacuum distillation through line 82 as a further contaminant for the "dirty oil" cracking system. This system does, however, carry out the function of protecting the hydrodesulfurization catalyst from the effects of contact with the mineral sediment.

In the present invention the total processing system is improved by passing the backwash topped crude oil through filter 60B, line 84, cooler 88 and line 90A and into crude oil tank 12 or alternatively through line 90B into the suction of pump 16 downstream of tank 12. The topped crude that has been used to backwash filter 60B is thereby mixed with fresh crude oil on its way to the desalting unit 24 so that mineral residue can be removed without further contaminating the product oil system and in a manner designed to be ecologically sound.

The following is a calculated example, based on actual plant prior art operation, comparing the prior art operation and the operation in accordance with the invention. The example illustrates the decrease in sediment (metals, etc.) charged through line 82 in the vacuum reduced crude residual to subsequent catalytic cracking.

Using as the basis for the calculation a crude oil feed stock at line 10 having a gravity of 30° API 60F/60F and 60 ppm sediment and using an 85 percent sediment removal in the desalting operation, the invention results in a reduction of 605 pounds per day of sediment and 20 pounds per day of metals charged to catalytic cracking because of charging the backwash oil from the filter to the desalting unit. This lower metals feed to the heavy oil cracking cuts catalyst consumption by about two tons per day.

The following table sets forth the calculated values with flows in barrels/day showing flows, metals contaminant and sediment at various points in the system both for the prior art system and this invention.

EXAMPLE

TABLE I

| | | Prior Art | Invention |
|---|---|---|---|
| (10) | Crude Oil Charge, | 183,000 | 183,000 |
| | Ni + V + Fe, lbs./day, | 1,872 | 1,872 |
| | Sediment, lbs./day, | 3,364 | 3,364 |
| (90A) | Backwash (Topped Crude), | 0 | 1,500 |
| | Ni + V + Fe, lbs./day, | 0 | 38 |
| | Sediment, lbs./day, | 0 | 711 |
| (18) | Total to Desalting, | 183,000 | 184,500 |
| | Ni + V + Fe, lbs./day, | 1,872 | 1,910 |
| | Sediment, lbs./day, | 3,364 | 4,075 |
| (30) | BS & W from Desalting, lbs./day, | 2,859 | 3,464 |
| | Ni + V + Fe, lbs./day, | — | — |
| | Sediment, lbs./day, | 2,859 | 3,464 |
| (32) | Crude from Desalting, | 183,000 | 184,500 |
| | Ni + V + Fe, lbs./day, | 1,872 | 1,910 |
| | Sediment, lbs./day, | 505 | 611 |
| (52) | Topped Crude, | 75,000 | 76,500 |
| | Ni + V + Fe, lbs./day, | 1,872 | 1,910 |
| | Sediment, lbs./day, | 605 | 711 |
| (66) | Filtered Topped Crude, | 73,500 | 75,000 |
| | Ni + V + Fe, lbs./day, | 1,835 | 1,872 |
| | Sediment, lbs./day | 0 | 0 |
| (74) | HDS Topped Crude, | 70,000 | 71,500 |
| | Ni + V + Fe, lbs./day, | 672 | 689 |
| | Sediment, lbs./day, | 0 | 0 |
| (64) | Backwash (Topped Crude), | 1,500 | 1,500 |
| | Ni + V + Fe, lbs./day, | 37 | 38 |
| | Sediment, lbs./day, | 12 | 14 |
| (84) | Used Backwash (Topped Crude), | 1,500 | 1,500 |
| | Ni + V + Fe, lbs./day, | 37 | 38 |
| | Sediment, lbs./day, | 605 | 711 |
| (82) | Vacuum Reduced Crude, | 49,000 | 49,000 |
| | Ni + V + Fe, lbs./day | 709 | 689 |
| | Sediment, lbs./day | 605 | 0 |

Note:
HDS means hydrodesulfurized

We claim:

1. A method for removing minerals from an at least partially desalted, topped crude oil comprising:

(a) passing said at least partially desalted, topped crude oil, through a filtering means with mineral sediment retained on said filtering means to provide a topped crude oil stream reduced in mineral sediment, (b) backwashing said filtering means with at least partially desalted, topped crude oil to remove mineral sediment from the filtering means thereby providing a desalted, topped crude oil stream increased in mineral sediment, and (c) passing the desalted topped crude oil stream increased in mineral sediment from the backwashing to a desalting operation wherein mineral sediment is at least partially removed.

2. A method of claim 1 further comprising:

(1) combining said desalted topped crude oil stream increased in mineral sediment produced in step (c) with a stream of fresh crude oil containing mineral sediment before passing the combined stream to said desalting operation, (2) passing at least partially desalted, crude oil to a fractionation operation, and (3) recovering an at least partially desalted topped crude oil stream from said fractionation.

3. A method of claim 1 further comprising:

(1) hydrodesulfurizing said topped crude oil stream reduced in mineral sediment produced in step (a) to provide a hydrodesulfurized topped crude stream, and (2) vacuum distilling said hydrodesulfurized topped crude stream to produce a vacuum gas oil product stream and a residuum stream.

4. A method of claim 2 further comprising:

(1) hydrodesulfurizing said topped crude oil stream reduced in mineral sediment produced in step (a) to provide a hydrodesulfurized topped crude stream, and (2) vacuum distilling said hydrodesulfurized topped crude stream to produce a vacuum gas oil product stream and a residuum stream.

* * * * *